US005567903A

United States Patent [19]

Coopersmith et al.

[11] Patent Number: 5,567,903

[45] Date of Patent: Oct. 22, 1996

[54] TRANSDUCER ASSEMBLY FOR A STRINGED MUSICAL INSTRUMENT

[75] Inventors: Jonathan Coopersmith, Philadelphia; Nathaniel Weiss, Merion Station, both of Pa.; Henry Madden, Modesto, Calif.

[73] Assignee: Lyrrus Incorporated, Philadelphia, Pa.

[21] Appl. No.: 375,017

[22] Filed: Jan. 19, 1995

Related U.S. Application Data

[60] Continuation-in-part of Ser. No. 168,267, Dec. 14, 1993, Pat. No. 5,408,911, which is a division of Ser. No. 664,208, Mar. 4, 1991, Pat. No. 5,270,475.

[51] Int. Cl.[6] ..... G10H 3/08

[52] U.S. Cl. ..... 84/723; 84/727; 84/743

[58] Field of Search ..... 84/723–727, 743

[56] References Cited

U.S. PATENT DOCUMENTS

| | | | |
|---|---|---|---|
| 3,869,952 | 3/1975 | Rowe | 84/727 |
| 3,956,963 | 5/1976 | Milton | 84/296 |
| 4,142,435 | 3/1979 | Pozar | 84/727 |
| 4,357,852 | 11/1982 | Suenaga . | |
| 4,495,641 | 1/1985 | Verino | 84/743 |
| 4,606,255 | 8/1986 | Hayashi et al. . | |
| 4,911,054 | 3/1990 | McClish | 84/725 |
| 5,012,716 | 5/1991 | Pagelli | 84/727 |
| 5,335,576 | 8/1994 | Hayashi | 84/727 |
| 5,354,949 | 10/1994 | Zwaan | 84/727 |
| 5,401,900 | 3/1995 | Lace | 84/743 |

*Primary Examiner*—Brian Sircus

*Attorney, Agent, or Firm*—Panitch Schwarze Jacobs & Nadel, P.C.

[57] ABSTRACT

A transducer assembly for an electronic music system for use with a stringed instrument includes a plurality of transducers and a quick connect device for detachably securing the transducers to the stringed instrument without marring, defacing, or altering the stringed instrument. The transducers generate analog signals representing the sound generated by playing the instrument. An interface converts the analog signals to digital signals and a computer receives and processes the digital signals. The location of the transducer assembly relative to the strings of the instrument is adjustable.

26 Claims, 4 Drawing Sheets

TRANSDUCER ASSEMBLY FOR A STRINGED MUSICAL INSTRUMENT

This application is a continuation-in-part of U.S. patent application Ser. No. 08/168,267 filed Dec. 14, 1993, now U.S. Pat. No. 5,408,911, entitled "Electronic Music System" which is a divisional application of U.S. patent application Ser. No. 07/664,208 filed Mar. 4, 1991, now U.S. Pat. No. 5,270,475.

FIELD OF THE INVENTION

The present invention relates to electronic music systems, and more particularly, to music systems in which an electronic signal is generated in response to the playing of a stringed instrument, such as a guitar.

BACKGROUND OF THE INVENTION

Electronic music systems employing a computer which receives and processes musical information are known. For example, keyboard systems use key actuated switch closures to generate signals representing musical information. That is, the keys on the keyboard act as switches and directly provide digital information to the computer. In such systems, the input device is not in fact a traditional musical instrument but is a keyboard and a computer which simulate a keyboard instrument.

Unlike keyboard instruments, stringed instruments do not generate sound via depressing a key but rather by way of string vibration. Since a string does not act like an on-off switch, a more complex means for converting the sounds generated by the instrument into electrical signals must be provided.

Various approaches have been used to create electronic music systems in which the input device is not a traditional keyboard, but is a device simulating a musical instrument. For instance, guitar-like devices have been made which utilize contacts actuated by playing the instrument in order to generate signals representing such playing. Such devices are also not truly musical instruments, but are dedicated computer input devices, which function similar to, but are shaped differently than an ordinary keyboard.

Various other attempts have been made to mate a guitar-like musical input device with a computer system. For instance, special-purpose guitars have been constructed in order to provide a computer input more nearly corresponding to the output of a guitar. For example, guitars have been constructed using strings all of the same gauge which are tuned to high frequencies; this provides easy detection of string and fret data, but precludes playing without the computer attached to the guitar. Such special purpose guitars have not been well received, in part because construction features necessary for signal acquisition render these guitars substantially different from ordinary guitars, and guitarists may be unwilling to purchase an additional guitar solely for the purpose of providing an input to a computer system. Moreover, many guitarists have strong feelings for their guitar, or have a favorite guitar with which they wish to play. Thus, these guitarists may also be unwilling to purchase or even use another guitar.

String vibration information can be captured and converted to electrical signals representing sound data by a transducer attached to the musical instrument. In order to accurately capture vibration data or sound information, the transducer must be properly positioned proximate the strings. The present invention provides a transducer assembly connectable to a musical instrument for converting sound information from vibrating strings into electrical signals representing the sound information. In addition, since, as previously discussed, many guitarists have strong feelings for their guitars and would not want to alter, mar or damage their guitar in order to equip it with a transducer, the present invention provides a method of attaching the transducer assembly to a guitar which does not mar or damage the guitar. The transducer assembly of the present invention may be detachably secured to a stringed instrument without marring, defacing, or modifying the instrument and, when attached, does not interfere with normal playing of the instrument. Further, the transducer assembly is adjustable in order to control the distance of the transducer assembly from the strings.

SUMMARY OF THE INVENTION

Briefly stated, the present invention is directed to a transducer assembly for use with a stringed instrument having a plurality of strings. The transducer assembly comprises a plurality of transducers which detect vibrations of each of the strings individually and convert respective string vibrations into corresponding electrical signals representative of the string vibrations. A quick connect device is provided for releasably securing the plurality of transducers to a surface of the instrument proximate the strings, wherein the surface of the instrument remains free of any indications related to the quick connect device. A means for interfacing the electrical signals with an electronic device is also provided.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Figure 1:
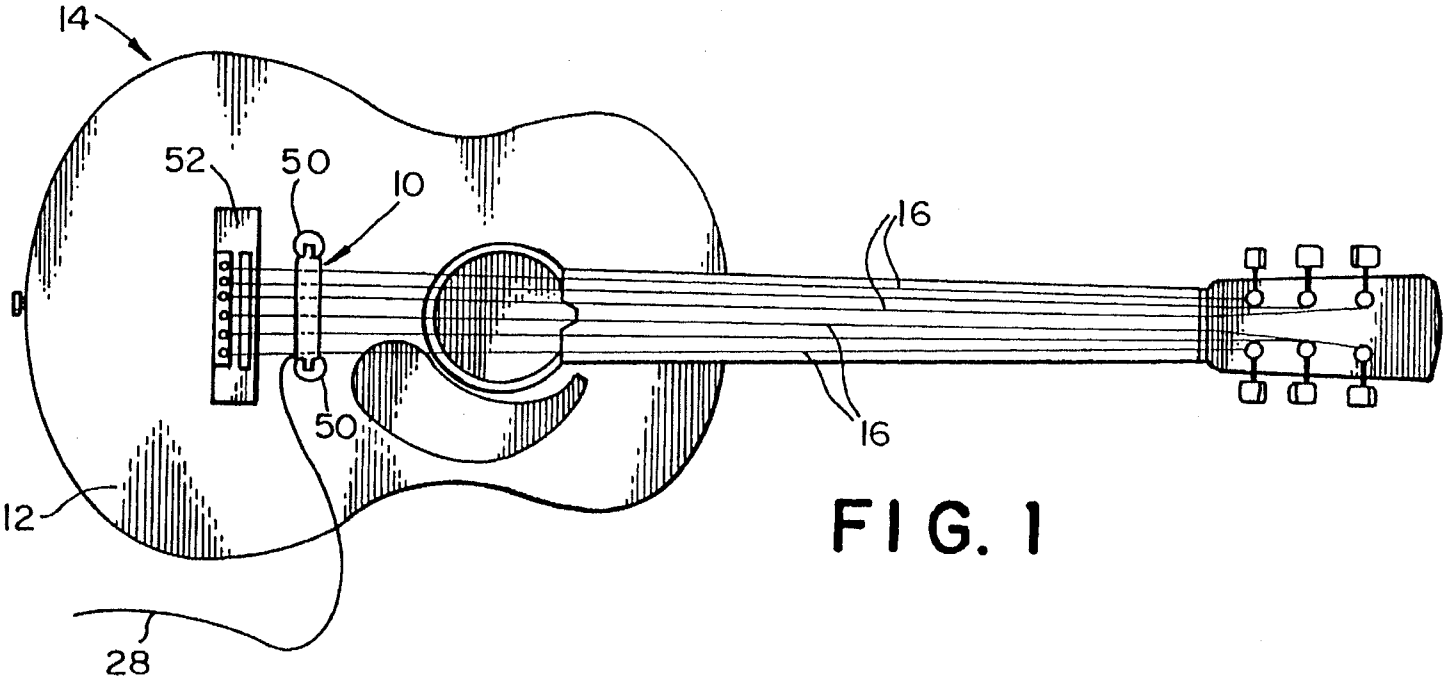
FIG. 1 is a plan view of a transducer assembly attached to a stringed instrument according to a preferred embodiment of the present invention.
Figure 2:
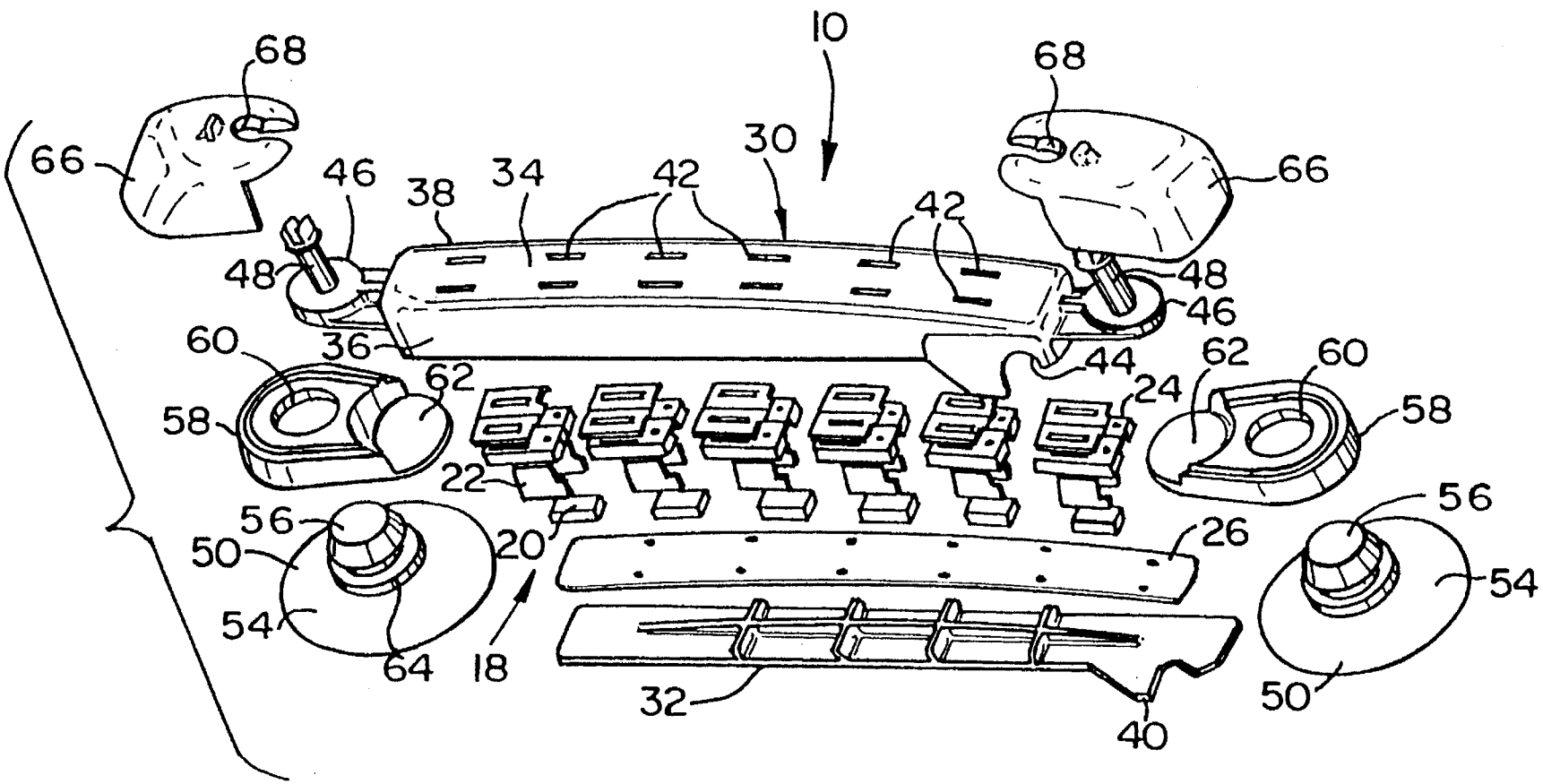
FIG. 2 is an enlarged, exploded perspective view of the transducer assembly shown in FIG. 1.

Referring now to the drawings in detail, wherein like numerals indicate like elements throughout, there is shown in FIGS. 1 and 2 a presently preferred embodiment of a transducer assembly, indicated generally at 10, for mounting to a surface 12 of a stringed musical instrument, such as a guitar 14 having a plurality of strings 16. As shown in FIG. 1, the transducer assembly 10 may be mounted on a surface 12 that is smooth and generally planar, such as the outer surface of the guitar 14. Although the transducer assembly 10 is shown mounted to a six-stringed guitar 14, it is understood by those skilled in the art that the transducer 10 may not only be used with any type of commercially available guitar, but may also be mounted to the surface of a banjo, mandolin, violin, twelve-stringed guitar, or any other stringed instrument. Accordingly, it is also understood by those skilled in the art that the present invention is not limited to use with a six-stringed instrument, but that the transducer assembly 10 may be modified to accommodate either fewer or more than six strings.

The transducer assembly 10 provides electrical output signals responsive to the vibrations of the guitar strings 16. Also, the transducer assembly 10 is constructed to be easily and quickly mounted to and easily and quickly detached from a guitar 14 (or other stringed instrument) without any modification to the guitar. Although it is preferred that the transducer assembly 10 is detachably securable to an instrument, it will be understood that in certain circumstances a manufacturer or musician may desire to more permanently secure the transducer assembly 10 to an instrument.

The transducer assembly 10 is for use in an electronic music system (not shown), such as the electronic music system disclosed in parent U.S. Pat. No. 5,270,475, which is hereby incorporated by reference in its entirety herein. It will be apparent to those of ordinary skill in the art that the transducer assembly 10 could also be used in other electronic music systems, such as a synthesizer system.

Referring now to FIG. 2, the transducer assembly 10 comprises a plurality of individual transducers, indicated generally at 18, for detecting vibrations of each of the strings 16 individually and converting respective string vibrations into corresponding electrical signals representative of the respective string vibrations. Each transducer 18, in the present embodiment, comprises a permanent magnet 20, a magnetic or ferromagnetic core 22 magnetically coupled to the magnet 20, and a conductive coil 24 wrapped around the core 22. The magnet 20 induces a magnetic flux to the core 22, which changes in magnitude when a string 16 proximate the transducer 18 vibrates. The change in the magnetic flux generates an electrical current in the coil 24 which is representative of the string vibration. It should be noted that the transducer 18 detects vibration from strings made of, containing, or including a magnetic material which is sufficient to change the magnetic flux in the core 22. As has been previously described, it is desirable for the present invention to be usable with any ordinary commercially available guitar, whether electric or acoustic, and regardless of the type of strings used on the guitar. Many guitars employ steel strings, whose movements may be directly detected by the ferromagnetic coils to generate a current output signal related to the movement of the strings. However, other types of guitar strings, particularly nylon strings, are not normally ferromagnetic and thus their movement is not detectable by the transducers 18. Applicant has discovered that nylon and similar guitar strings may be provided with ferromagnetic properties so that they may be detected by typical transducers 18. Further details of electrical principles of the transducers 18 are not necessary for a complete understanding of the present invention and therefore, are not further discussed herein. Moreover, the general electrical principles of transducers for converting vibrations into electrical signals are generally known by those of ordinary skill in the art who also know that other means for producing an electrical output signal responsive to string movement may be used as transducers in the present invention without departing from the scope of the invention. Suffice it to say that the transducers 18 detect and convert a string vibration into an electrical signal representative of the duration and volume of the string vibration.

In the presently preferred embodiment, the number of transducers 18 corresponds to the number of strings 16 of the stringed instrument 14, although more than one transducer could be provided for each string of the instrument. That is, one transducer 18 is provided for each string 16 of the guitar 14. Thus, for a six-string guitar, six transducers 18 are provided. When the transducer assembly 10 is properly positioned, as discussed in greater detail below, each transducer 18 is located proximate to a separate string 16 and produces an electrical signal primarily responsive to movement of that string 16. The transducers 18 are spaced from one another at about the standard spacing of guitar strings 16 so that one transducer 18 is positioned adjacent each string 16 when the transducer assembly 10 is mounted to a guitar 14. Although the standard guitar string spacing varies depending on the type of guitar, it has been found that a single spacing at the mean of the minimum and maximum traditional spacings positions the ferromagnetic coils 24 sufficiently accurately to enable detection with any such guitar string spacing. Standard guitar string spacing (E-E) ranges from 2.03 inches to 2.25 inches, or about 0.41 to about 0.45 inches between adjacent strings. By spacing the transducers 18 at about the mean spacing of 0.43 inches, or preferably in the range of about 0.42 to about 0.44 inches, adequate coil output for use in the present invention may be obtained over the entire range of standard guitar string spacings. This is one aspect which permits the transducer assembly 10 of the present invention to be applied to a wide variety of guitars.

For ease of connection and mounting, the transducers 18 are mounted on a printed circuit board (PCB) 26. Preferably, the transducers 18 are mounted in fixed positions on the PCB 26, in a generally linear orientation, at a generally uniform spacing along such a line or orientation. It will be understood that the transducers 18 may also be mounted by means permitting mechanical adjustment of the transducer 18 spacing to permit the spacing to be adjusted to correspond to the string spacing of a particular guitar. It will also be understood that the transducers 18 may be oriented in a line perpendicular to the strings 16. For instance, with transducers which have a diameter larger than the string spacing, it may be necessary to mount the transducers on a PCB in a staggered fashion or in a line which is not perpendicular to the strings 16. The PCB 26 includes metal interconnects or conductors (not shown) as is known to those of ordinary skill in the art for connecting the transducers 18 to a communications port (not shown) on the PCB 26 which allows an interface or cable, such as a cable 28 (FIGS. 1 and 3) to be connected to the PCB 26. The cable 28 provides a communication channel which allows the electrical signals to interface with an electronic device (not shown).

Desirably, the communication channel or cable 28 comprises a standard cable assembly such as a multi-conductor cable having the conductors at one end connected to the PCB 26 and a connector, such as a mini-din connector for connecting to a serial port of a personal computer. An eight conductor cable is particularly preferred. One conductor may be used as a common or ground line. In order to provide output information unambiguously for each of the strings 16 of the guitar 14, six of the conductors may be coupled to the active or non-grounded end of a the six different ferromagnetic coils 24. If six of the conductors are dedicated to coil outputs, one conductor remains available to provide further functionality, such as transmitting control information to and/or from the PCB 26 or if necessary, for transmitting power to the transducer assembly 10. Moreover, other information could also be transmitted to and from the transducer assembly 10 either by adding conductors, using different frequencies over the same conductors, or multiplexing signals over some of the conductors. All of these techniques are known by those of ordinary skill in the art.

In the presently preferred embodiment, the PCB 26 is sized to fit the transducers 18 in a linear orientation at a predetermined spacing, as previously discussed. Preferably, the PCB 26 is no larger than necessary to hold the transducers 18, which is about 2.5 inches in length and 0.25 inches in width. Since PCBs are well known to those of ordinary skill in the art and readily commercially available, the PCB 26 is not further discussed herein.

The transducer assembly 10 further comprises an elongate housing having a top portion 30 and a bottom portion 32. The top portion 30 has a top surface 34 and oppositely disposed sidewalls 36, 38. The transducers 18 mounted on the PCB 26 are located within the housing. The housing protects the transducers 18 from being damaged due to handling or mishandling.

The housing bottom portion 32 is generally flat and rectangular in shape and is sized to be slightly larger than the PCB 26. The housing bottom portion 32 also includes a grooved flange 40 proximate one end. Although the housing bottom portion 32 shown in FIG. 2 is generally flat, it will be apparent to those of ordinary skill in the art that the housing bottom portion 32 could also have integral side walls, forming a recess for receiving the PCB 26.

The housing top portion 30 is also generally rectangular in shape and is sized to hold the PCB 26 and the transducers 18 therewithin. The top surface 34 may be either flat or arcuate shaped and may include a visual indication of the location of the transducers 18 in order to aid a user in properly positioning the transducer assembly 10 on the surface 12 of the guitar 14 such that one transducer 18 is located proximate each string 16. The visual indication may comprise a mark, slot or groove, and in the preferred embodiment comprises a plurality of generally rectangular openings or slots 42. In the presently preferred embodiment the slots 42 are paired such that there are two slots 42 per transducer 18. However, it will be apparent to those of ordinary skill in the art that fewer or different markings could be used to indicate the location of the transducers 18 within the housing.

The housing top portion 30 has a grooved flange 44 located in side wall 36 which corresponds to the grooved flange 40 on the bottom portion 32 such that when the top portion 30 and the bottom portion 34 are assembled together, the grooved flange 40 and the grooved flange 44 form a hole in the housing. The hole allows the cable 28 to enter the housing and electrically connect to the PCB 26.

Thus, with the PCB 26 and the transducers 18 located within the housing top portion 30, the housing is assembled by attaching the housing bottom portion 32 to the top portion 30. The housing may be maintained in its assembled condition by any suitable means, such as gluing or by providing mating interference connections on the top portion 30 and the bottom portion 32.

The housing is preferably made from a strong, light and durable non-magnetic material, such as a polycarbonate material. However, it is understood by those of ordinary skill in the art from this disclosure that other materials could be used, such as other polymeric materials, metal or wood. The housing may be a molded plastic shell or the like constructed by a molding process, such as injection molding. However, it is understood by those of ordinary skill in the art from this disclosure that other molding processes could be used to construct the housing, such as casting and transfer molding, without departing from the spirit and scope of the invention.

The housing top portion 30 also includes a pair of integral annular rings 46 which project outwardly from opposite ends thereof. The rings 46 are sized to receive a threaded member 48, the purpose of which will become apparent below. The inner surfaces of the rings 46 are also threaded, so that the rings 46 and the threaded member 48 are in threaded engagement. Although the bottom portion 32 does not have projecting annular rings corresponding to the rings 46, it will be apparent to those of ordinary skill in the art that the bottom portion could include annular rings which correspond to and mate with the rings 46 sized to also receive the threaded members 48.

The transducer assembly 10 includes a quick connect device or means for detachably securing the transducer assembly 10 to the Surface 12 of the guitar 14 so that the transducer assembly 10 may be quickly and easily attached to the surface 12 and so that the transducers 18 are properly spaced adjacent the strings 16 of the instrument, preferably in the region of the bridge 52 of the instrument. The quick connect device desirably does not result in any marring, defacing, or modification to the guitar 14 in order to mount the transducer assembly 10. Thus, it is preferred that the quick connect device attaches only to the surface 12 of the guitar 14 so that the guitar 14 remains free of any indications related to the quick connect device. By indications, it is meant to permanent marks, such as a hole or a scratch and not a mark which may be rubbed away. In the preferred embodiment, as described below, the quick connect device may leave a small ring on the instrument finish which may be polished or rubbed away on most instruments. The preferred embodiment of the quick connect device, as shown in FIG. 2, includes a pair of suction cups 50 which are coupled to the ends of the housing and adapted to be detachably secured by suction to the surface 12 of the guitar 14.

It is highly desirable that the transducer assembly 10 be mounted to the guitar 14 in a way which does not require any permanent modifications, such as drilling of holes in the guitar 14. Suction cups 50 are preferred, but other means for such mounting may be employed, such as a complementary hook and loop fasteners or a belt or strap attached to the transducer assembly 10 and adapted to be placed around the guitar body, or mounting in the same manner as the guitar strings are attached to the guitar body.

The suction cups 50 are generally dome shaped and include an outer perimeter 54 and a head 56. The head 56 extends upwardly from the upper surface of the suction cup 50. The suction cups 50 form a vacuum seal when depressed, thus securely holding the transducer assembly 10 to the surface 12. The suction cups 50 may also include a small release tab (not shown) on the outer perimeter 54 to aid in breaking the vacuum seal and removing the assembly 10 after it has been placed in sealing contact with the surface 12.

The suction cups 50 preferred are relatively small so as not to be obtrusive or to distract the instrument player, yet are large enough to provide secure attachment of the housing. Suction cups are generally known and are available in a wide variety of sizes. Although various size suction cups can be used to practice the present invention, it has been found that a suction cup having a diameter of approximately less than one inch (when depressed) provides sufficient gripping to securely attach the transducer assembly 10 to the surface 12. Although the suction cups may be constructed of plastic, in the preferred embodiment the suction cups are constructed of silicon because plastic has been found to mar or eat away the finish on the surface of an instrument. For example, many guitars have a nitrocellulose finish, which the plastic of a suction cup will mar. Since suction cups of the type used in the presently preferred embodiment are generally known, well understood by those of ordinary skill in the art and widely commercially available, further description of the suction cups 50 is omitted and is not limiting.

A coupling member 58 is provided for coupling the suction cup to the housing. The coupling member 58 is generally flat and has a first, generally circular, large opening 60 sized to complementarily receive and capture the head 56 on the suction cup 50. The coupling member also has a second, generally circular, small opening 62 for receiving the end of the threaded member 48. The suction cup 50 may include a narrow groove or slot 64 around the head 56 for receiving the perimeter of the first opening 60 and securing the suction cup 50 to the coupling member 58. Alternatively, an adhesive, such as a cyanoacrylate-type adhesive, may be disposed between the head 56 and the first opening 60 in the coupling member 58 to secure the suction cup 50 to the coupling member 58 and to prevent the suction cup 50 from rotating with respect to the coupling member 58. It is understood by those skilled in the art that the suction cup 50 could be adhesively secured to the coupling member 58 in other manners. For instance, a flexible hot melt glue (not shown) could be disposed between the upper surface of the suction cup 50 and the coupling member 58 to further prevent the suction cup 50 from rotating with respect to the coupling member 58. It will be understood by those of ordinary skill in the art that further methods of securing together the suction cup 50 and the coupling member 58 could be used, such as the suction cup 50 could be secured to the coupling member 58 with a friction fit and adhesive combination (not shown) without departing from the spirit and scope of the invention.

A hood shaped cover piece 66 is provided for covering the coupling member 58 and the head 56 of the suction cup 50. The cover piece 66 mates to and is secured to the coupling member 58 by any suitable means, such as by gluing the two pieces together or by providing mating interference fit or snap-in connections between the two pieces. A slot or groove 68 is provided on the top of the cover piece 66 to allow access to the head of the threaded member 48, as described in more detail below.

When assembled, the housing top portion 30 and bottom portion 32 are secured together in mating engagement and house the PCB 26 and the transducers 18. The threaded members 48 are in threaded engagement with the annular rings 46 of the housing top portion 30. The suction cups 50 are secured to the coupling members 58 and the coupling members 58 are secured in mating engagement with the cover pieces 66. In addition to being in threaded engagement with the annular rings 46, a first end of each of the threaded members 48 is received in the second openings 62 in the coupling members 58 and a second, opposite or head end of the threaded members 48 projects into the slots 68 in the cover pieces 66. The housing is thus secured to the quick connect device by means of the coupling members 58, the cover pieces 66 and the threaded members 48. In addition, the housing may be moved with respect to the quick connect device in that the housing rotates on the threaded member 46. The rotational movement of the housing with respect to the quick connect device is limited by the housing contacting the sidewalls of the cover piece 66. Movement of the housing with respect to the quick connect device allows for more particular placement of the housing, and thus the transducers 18 with respect to the strings 16. It has also been determined that by making the position of the housing adjustable, the transducer assembly 10 may be secured to a wide variety of commercially available guitars without interfering with the strings or other portions of such guitars.

The transducer assembly 10 shown in FIGS. 1 and 2 is designed to be mounted between surface 12 of the guitar 14 and the strings 16. Since the overall dimensions of the transducer assembly are relatively small (the housing is approximately 2.5 inches in length by 0.38 inches in height and 0.38 inches width), the transducer assembly 10 may be used with a wide variety of commercially available instruments without the need for any modifications. In order to ensure that an optimum signal is obtained by transducers 18, the transducers 18 should be placed as close as possible to the strings 16 without interfering with their movement. However, the height of the strings 16 above guitar surface 12 varies from guitar to guitar. Accordingly, the transducer assembly 10 of the present invention includes means for adjusting the distance between the housing and the surface 12, and thus the distance between the housing and the strings 16, so that the transducer-string spacing may be optimized. The preferred means for adjusting the transducer-string spacing comprises rotating the threaded members 48 engaged with the housing. As previously discussed, the head end of the threaded members 48 is accessible through the slot 68 in the cover piece 66. The threaded members 48 can comprise screws wherein the screw head is accessible through the slot 68. Accordingly, rotation of the screws either raises of lowers the housing along the length of the screw. In the presently preferred embodiment, the screws have a length of approximately 0.5 inches which allows for adequate adjustment of the distance between the housing and the strings 16. It will be understood by those of ordinary skill in the art that providing a screw or threaded member 48 of longer length allows for greater adjustability of the transducer-string spacing and that if a sufficiently long threaded member 48 is provided, the housing could be located above the strings 16.

The screws or threaded member 48 may have a slot in the head, as is commonly known, so that the threaded member 48 can be rotated by a screwdriver or similar tool. Alternatively, the threaded member 48 may comprise a post or pin having a thumbwheel (not shown). It will be understood by those of ordinary skill in the art that transducer assembly 10 may be provided with other means for adjusting the transducer-string spacing, such as means for adjusting the position of the individual transducers 18 within housing.

It is also known that adjusting the spacing between the transducer assembly 10 and the strings 16 could be monitored through electronic means by providing a sensor (not shown) on the transducer assembly 10 which indicates when the transducer assembly is optimally located on the guitar 14. For instance, when the housing reaches a predetermined height so as to contact any of the strings 16, assuming the strings 16 are conductive, the sensor could illuminate an LED (not shown), indicating that the assembly 10 has contacted the strings 16, and therefore should be moved away from the strings 16 by a predetermined amount by any convenient means, such as effecting a predetermined number of turns of the threaded members 48. The predetermined transducer-string distance should be set so that the transducers are as close as possible to the strings 16 without the possibility of the strings 16 contacting the transducers 18 or the housing during vigorous playing.

Setting the transducer-string spacing could also be accomplished in an interactive process under control of software in a computer system in communication with the transducers 18 by way of cable 28. The computer system could receive data from the transducer assembly 10 based on the strength of the signals output by the transducer assembly 10, and could display information such as an image of transducers 18 and strings 16 to assist the user in adjusting the spacing.

Figure 4:
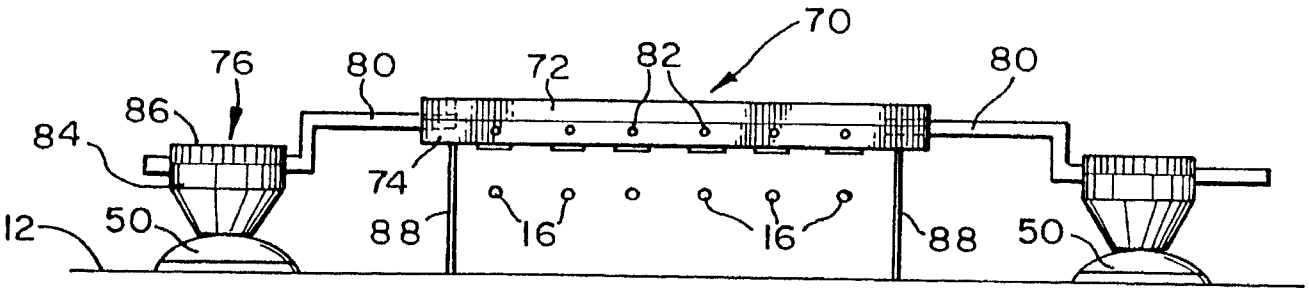
FIG. 4 is an enlarged front elevational view of the transducer assembly shown in FIG. 3 on an instrument.
Figure 3:
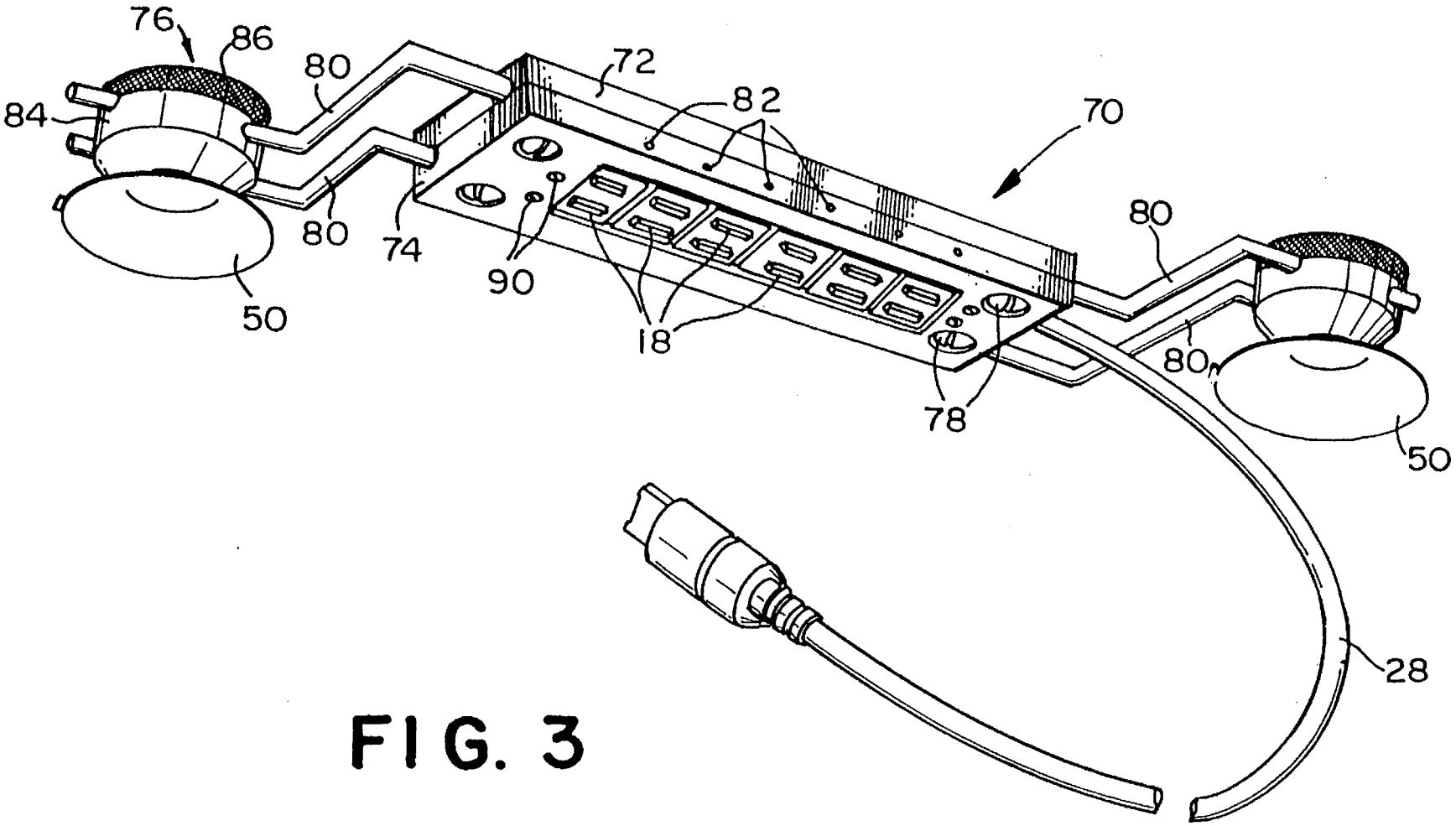
FIG. 3 is an enlarged perspective view of an alternate embodiment of a transducer assembly in accordance with the present invention.

Referring now to FIGS. 3 and 4, an alternate embodiment of the transducer assembly is shown and indicated generally at 70. The transducer assembly 70, in contrast to the transducer assembly 10, is designed to preferably be located on the surface 12 of the guitar 14 proximate the strings 16 such the strings 16 are disposed between the surface 12 and the housing of the transducer assembly 70. That is, the housing of the transducer assembly 70 is above the strings 16, whereas the transducer assembly 10 is preferably located between the strings 16 and the surface 12.

The transducer assembly 70 includes a housing having a top portion 72 and a bottom portion 74. The housing top and bottom portions 72, 74 are similarly sized and shaped for housing a plurality of transducers 18 mounted on a PCB (not shown), as previously discussed for the first embodiment. Accordingly, the top and bottom portions are generally rectangular in shape and like the housing of the transducer assembly 10, are preferably constructed of a molded plastic. The top and bottom portions 72, 74 may be secured together by screws 78 which pass through clearance holes in the bottom portion 74 and are threaded into the top portion 72. Alternatively, other means for securing the top and bottom portions 72, 74 together can be used as will be apparent to those of ordinary skill in the art, such as gluing, bonding, or using a complementary tongue and groove means.

Visual indicia in the form of alignment marks 82 may be located on either of the top portion 72 or the bottom portion 74 (as shown) to aid a user in positioning the assembly 70 so that the transducers 18 are aligned with the strings 16. The marks 82 may comprise vertical lines or dots and may be painted or stenciled on to the housing.

The transducer assembly 70 also includes means for interfacing the electrical signals generated by the transducers 18 representative of string vibrations to be conducted to an electronic device (not shown). The interface means, as previously described, comprises a multiconductor cable 28 which passes through a hole (not shown) in the housing and connects to the PCB (not shown).

The transducer assembly 70 includes at least one quick connect device, indicated generally at 76, coupled to the transducer assembly 70 for quickly connecting and disconnecting the transducer assembly 70 to the surface 12 of the guitar 14 and for adjustably positioning the housing with respect to the strings 16. The quick connect device 76 allows the assembly 70 to be connected to the surface 12 without marring, defacing, or otherwise marking the surface 12, such that the surface 12 remains free of any indications related to the quick connect device 76. Accordingly, it is preferred that the quick connect device 76 attaches only to the surface 12 of the guitar 14 and does not penetrate the surface 12. In the embodiment shown in FIGS. 3 and 4, two quick connect devices are provided for attaching the housing to the surface 12 located at opposing ends of the housing. However, it will be understood that more than two quick connect devices could be coupled to the housing to provide for a more secure attachment.

Suction cups 50 are the most preferred means for detachably securing the assembly 70 to the surface 12, since they are inexpensive and readily available in a wide variety of sizes, provide adequate securing force, are detachably securable without marring the surface 12, are easily repositioned, and adhere to most, if not all stringed instrument surfaces. Other suitable attachment means include certain adhesives which can be applied to a surface to mount an item, can be removed without marring the surface or leaving a substantial residue, and maintain their tack so that they may be reapplied to a surface. If modification of the instrument is acceptable, a variety of known devices may be used to provide a detachably securable, adjustably positionable mounting.

Coupling members in the form of arms 80 join the housing to the quick connect device 76. The arms 80 permit relative movement between the quick connect device 76 and the housing. The relative movement permits the assembly 70 to be positioned so that the housing and thus the transducers 18 are in an appropriate position for detecting and responding to vibration of the strings 16 when the quick connect device 76 is secured to the surface 12 of the instrument. The arms 80 provide articulated coupling of the housing to the quick connect device 76. The housing is provided with journals (not shown) for accommodating the arms 80. In the embodiment shown in FIGS. 3 and 4, two pairs of generally parallel arms are provided for coupling the housing to the quick connect device 76. The arms 80 may be rotatable within the journals in the housing so that each quick connect device 76 is movable with respect to the housing in an arc, with the length of the arc depending on the geometry of the arms 80. Preferably, the journals also permit the arms 80 to permit a limited sliding movement into and out of the housing to allow the quick connect device 76 to be spaced closer or further from the housing. Thus, the relative positions of the quick connect devices 76 to each other and the housing is adjustable. The screws 78 in the housing may be tightened in order to inhibit the movement of the arms 80. The arms 80 may be formed from aluminum welding rod of 3/32" diameter, although other materials are suitable. Moreover, instead of forming the arms from a single rod including bends in the arms 80 (as shown), the arms 80 may comprise separate segments joined for articulate movement in any suitably permanent manner.

Each arm 80 in a pair of arms may have the same dimensions and the dimensions between the pairs of arms may be either the same or different, although it has been found that varying the length of the arms between pairs improves stability. The length of the arms 80 may be selected according to the dimensions of the stringed instrument to which the assembly 70 is to be attached. Similarly, the angles formed by the bends in the arms are preferably generally equal between arms so that the arm in a pair of arms are parallel to each other. As shown in FIG. 3, it is preferred that the quick connect devices 76 are displaced in opposite directions, which provides for more stable and secure attachment.

The quick connect device 76 comprises a suction cup 50 secured to a support member 84. The support member 84 may include an opening for frictionally engaging a head of the suction cup 50 or the suction cup 50 may be secured to the support member 84 in any other suitable manner, such as by gluing or an adhesive, or with a combination of an opening and an adhesive. A pair of grooves is provided on a surface (not shown) of the support member 84 for receiving the arms 80 and a friction adjusting screw 86 is in threaded engagement with the support member 84 for securing the arms 80 within the grooves. The screw 86 may be loosened to allow the position of the arms 80 to be adjusted within the grooves and tightened to prevent further movement of the arms 80 within the grooves. Alternatively, other means of securing the arms 80 to the support member 84 will be apparent to those of ordinary skill in the art, such as ball and socket type arrangement.

A plurality of rigid support members 88 (shown only in FIG. 4) may also be provided to prevent deflection of the housing toward the strings 16. A set of holes 90 (FIG. 4) may be provided in the housing bottom portion 74 into which the support members 88 may be releasably inserted and captured. The support members 88 may be cut or selected to the appropriate length for a given instrument. The support members 88 may comprise a threaded portion of a screw which is advanced through a threaded hole in the housing bottom portion 74 to contact the instrument surface 12 when the assembly 70 is appropriately positioned.

Figure 5:
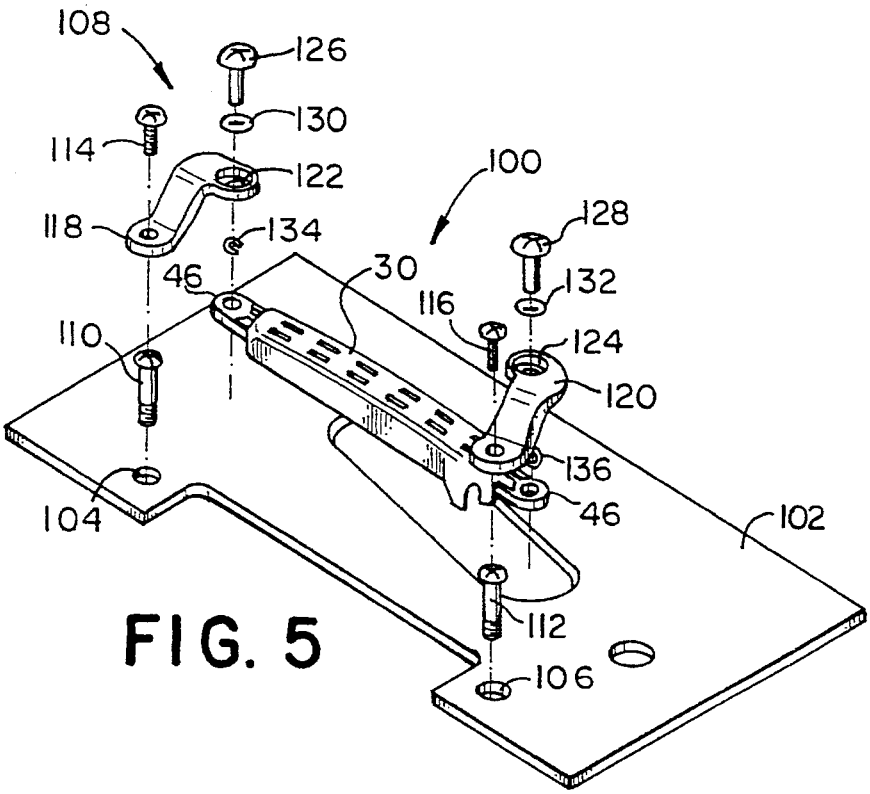
FIG. 5 is an enlarged, exploded perspective view of a third embodiment of a transducer assembly and for attaching to a pick guard of a guitar in accordance with the present invention.
Figure 6:
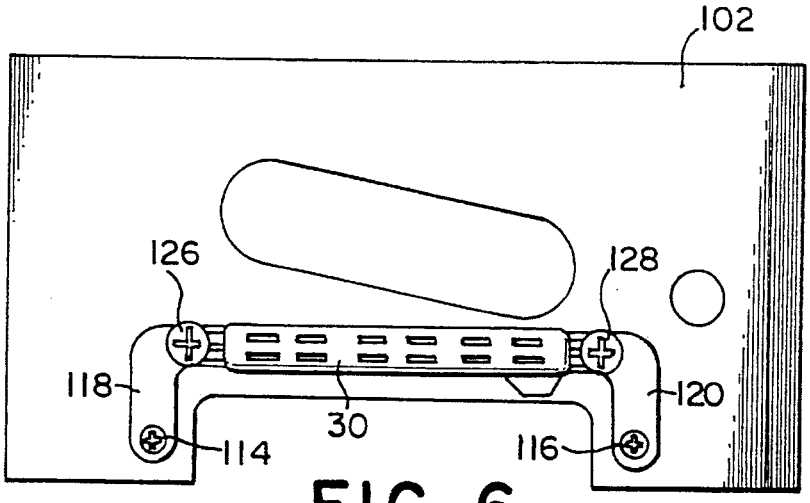
FIG. 6 is a top plan view of the transducer assembly of FIG. 5 attached to a pick guard.
Figure 7:
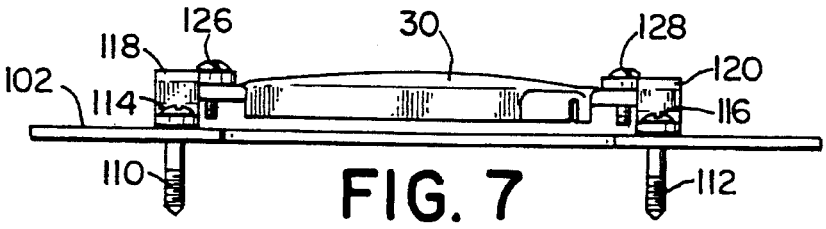
FIG. 7 is a front elevational view of the transducer assembly shown in FIG. 5 attached to a pick guard of an instrument.

Referring now to FIGS. 5–7, a third embodiment of a transducer assembly 100 is shown. The transducer assembly 100 is adapted to mount to a Fender guitar, such as a Fender Stratocaster or Telecaster guitar or a similar guitar. The transducer assembly 100, is similar to the transducer assembly 10, having the same housing, PCB, and transducers. However, the quick connect device, indicated generally at 108, for the transducer assembly 100 is different.

As previously discussed, the transducer assembly 100 is adapted to be mounted to a Fender guitar. A Fender guitar includes a pick guard 102 located on the guitar body which includes a pair of predrilled holes 104, 106 for receiving two small screws (not shown). In order to attach the transducer assembly 100 to the Fender guitar, the two small screws in the predrilled holes 104, 106 are removed and replaced with first and second threaded members 110, 112. The first and second threaded members 110, 112 are threaded on the outside and are sized to fit into and threadedly engage the predrilled holes 104, 106. The first and second threaded members 110, 112 also include a threaded bore for receiving first and second small screws 114, 116. The first and second small screws 114, 116 secure first and second arms 118, 120, respectively, to the pick guard 102 of the guitar.

The two arms 118, 120, secured to the pick guard 102, extend between the pick guard 102 and the annular rings 46 on the housing top portion 30. A first end of each of the arms 118, 120 includes a hole for receiving the two small screws 114, 116 to secure the arms 118, 120 to the pick guard 102. A second, opposite end of each of the arms 118, 120 also includes a recessed hole 122, 124, respectively, for receiving two screws 126, 128 and two O-washers 130, 132, respectively. The O-washers 130, 132 fit within the recesses 122, 124. The screws 126, 128 pass through the O-washers 130, 132, respectively, and then through the holes 122, 124, respectively in the arms 188, 120, and into threaded engagement with the annular threaded rings 46 of the housing. The screws 126, 128 also pass through an e-ring 134, 136, respectively, disposed between the arms 118, 120 and the annular rings 46. Thus, the housing is secured above the pick guard 102 of the guitar and below the strings (not shown) of the guitar.

Each arm 118, 120 is a machined piece of metal having screw holes disposed at opposite ends, as previously discussed. The first end of each of the arms 118, 120 is secured to the pick guard 102 and the second, opposite end of the arms 118, 120 is secured to the annular ring 46 of the housing. The arms 118, 120 are slightly L-shaped such that the recessed holes 122, 124 are offset from the holes in the first end of the arms 118, 120. In addition, the arms 118, 120 are not flat, but are bent or formed so that when each arm is properly positioned on the guitar, the second end is higher (i.e. further from the surface of the guitar) than the first end in order to maintain the housing proximate, but not in contact with the pick guard 102. Further, the two threaded members 126, 128 are not in contact with the pick guard 102 when inserted through the arms 118, 120 and the housing. As with the transducer assembly 10, the distance between the housing and the strings is adjustable by rotating the threaded members 126, 128. Alternatively, other means of securing the arms 118, 120 to the annular ring 46 will be apparent to those of ordinary skill in the art, such as a notched rivet type arrangement of metal or plastic. Although presently the arms 118, 120 are constructed from machined metal, it will be understood that the arms can be formed from other materials, such as molded plastic.

Thus, the transducer assembly 100 can be quickly connected to a Fender guitar without permanently altering or modifying the guitar. The quick connect device 108 provides a very secure attachment means and allows the distance between the housing and the strings to be adjusted. The quick connect device 108 also allows the transducer assembly to be easily removed from the guitar and allows the assembly 100 to be connected to the surface of the guitar without marring, defacing, or otherwise marking the surface 12, such that the surface 12 remains free of any indications related to the quick connect device 108. Accordingly, it is preferred that the quick connect device 108 attaches only to the pick guard 102 of the guitar using the existing predrilled holes 104, 106 and does not penetrate the surface 12.

From the foregoing description, it can be seen that the preferred embodiment of the invention comprises a transducer assembly for use on a surface of a stringed musical instrument which is operative to pickup a string vibration and convert the vibration into an electrical signal. The transducer assembly exhibits excellent adhesion characteristics, so that the transducer assembly remains stable and secure even when forces are exerted on the stringed instrument. Further, the transducer assembly can be easily and efficiently manufactured. It will be appreciated that changes and modifications may be made to the above described embodiments without departing from the inventive concept thereof. Therefore, it is understood that the present invention is not limited to the particular embodiment disclosed, but is intended to include all modifications and changes which are within the scope and spirit of the invention as defined by the appended claims.

We claim:

1. A transducer assembly for use with a stringed instrument having a plurality of strings, the transducer assembly for detecting and converting string vibrations into electrical signals representative of the string vibrations, comprising:

an elongate housing;

a plurality of transducers for detecting vibrations of each of the strings individually and converting respective string vibrations into corresponding electrical signals, wherein the plurality of transducers are located within the housing;

at least one coupling member;

a quick connect device coupled to the housing with the at least one coupling member for quickly connecting and disconnecting the housing only to a surface of the instrument proximate the strings, wherein the quick connect device comprises at least one suction cup and the coupling member includes a circular opening for receiving a head of the at least one suction cup and securing the suction cup thereto, and upon attachment, the surface of the instrument remains free of any indications related to the quick connect device; and means for interfacing the electrical signals with an electronic device.

2. The transducer assembly according to claim 1, wherein each transducer produces an electrical signal primarily responsive to movement of a string adjacent thereto.

3. The transducer assembly according to claim 1, wherein the plurality of transducers corresponds in number to the plurality of strings of the instrument, each transducer being located adjacent to a separate one of the strings and each transducer producing an electrical signal primarily responsive to movement of the string adjacent thereto.

4. The transducer assembly according to claim 1, wherein the quick connect device comprises two suction cups connected to opposite ends of the housing.

5. The transducer assembly according to claim 4 wherein the at least one coupling member comprises two coupling members for connecting each of the suction cups to the housing, wherein there is one coupling member for each suction cup.

6. The transducer assembly according to claim 5, further comprising means for adjusting the distance between the housing and the strings so that the distance between the transducers and the strings is variable.

7. The transducer assembly according to claim 6, wherein the adjusting means comprises a pair of cooperatively engaged threaded members.

8. The transducer assembly according to claim 7, wherein the housing comprises a top portion and a bottom portion, the housing top portion having a first end and a second, opposite end, and an annular ring extending outwardly from each of the first end and the second end.

9. The transducer assembly of claim 8 wherein the adjusting means comprises a screw at each end of the housing top portion in captured engagement with the associated annular ring and wherein the coupling member includes a second opening receiving an end of the screw so that turning the screw adjusts the distance between the transducers and the strings.

10. The transducer assembly of claim 9 further comprising a hooded cover piece for covering each coupling member and the head of the associated suction cup, wherein each cover piece frictionally engages a coupling member.

11. The transducer assembly according to claim 1, wherein the housing and the quick connect device are sized for securing the transducer assembly to the surface of the instrument between the instrument surface and the strings.

12. The transducer assembly according to claim 1, wherein the housing and the quick connect device are sized for securing the transducer assembly to the surface of the instrument such that the strings are disposed between the instrument surface and the housing.

13. The transducer assembly according to claim 1, wherein the housing includes visual indicia for guiding a user in aligning the transducer assembly with the strings.

14. The transducer assembly according to claim 1, further comprising a printed circuit board (PCB) in electrical communication with the plurality of transducers and the interfacing means comprises a cable connected to the PCB for transmitting the electrical signals to the electronic device.

15. A transducer assembly according to claim 1, wherein the transducers are mounted within the housing in positions which are fixed with respect to each other.

16. A transducer assembly according to claim 15, wherein the transducers are mounted in a generally linear orientation in positions having a substantially uniform spacing of about 0.41 inches to about 0.45 inches.

17. A transducer assembly for use with a stringed instrument having a plurality of strings, the transducer assembly for detecting and converting string vibrations into electrical signals representative of the string vibrations, comprising:

an elongate housing having a first end and a second, opposite end;

a plurality of transducers located within the housing for detecting vibrations of each of the strings individually and converting respective string vibrations into corresponding electrical signals, each transducer producing an electrical signal primarily responsive to movement of a string adjacent thereto;

a quick connect device for releasably securing the housing only to a surface of the instrument proximate the strings, wherein the surface of the instrument remains free of any indications related to the quick connect device and wherein the quick connect device comprises at least one suction cup;

at least one coupling device for coupling the housing to the quick connect device, wherein the coupling device includes an annular bore for receiving a head of the at least one suction cup; and an output connector in electrical communication with the transducers adapted to be coupled to a communication channel, whereby the electrical signals from the transducers are coupled to the communication channel.

18. A transducer assembly according to claim 17, further comprising means for adjusting the position of the housing with respect to the strings.

19. A transducer assembly for use with a stringed instrument having a plurality of strings comprising:

an elongate housing including a top portion having a top surface and opposing side walls and a separate, bottom portion;

a plurality of transducers located within the housing for detecting vibrations of each of the strings individually and converting respective string vibrations into corresponding electrical signals representative of the string vibrations, each transducer producing an electrical signal primarily responsive to movement of a string adjacent thereto;

means for releasably securing the housing to the instrument proximate the strings which does not mar the surface of the instrument;

at least one coupling member having an annular bore for receiving the securing means, wherein the housing top portion is interconnected to the securing means by the at least one coupling member; and means for interfacing the electrical signals with an electronic device.

20. The transducer assembly according to claim 19 wherein the transducers each comprise a permanent magnet, at least one magnetic core connected to the magnet, and a conductive coil around the core, wherein vibration of a string causes a change in magnetic flux of the core and the change in flux generates an electrical current in the coil representative of the string vibration.

21. The transducer assembly of claim 20 wherein the plurality of transducers corresponds in number to the plurality of strings of the stringed instrument, each transducer being located proximate an associated string when the transducer assembly is correctly positioned on the instrument surface.

22. The transducer assembly of claim 19 wherein the securing means comprises at least one suction cup.

23. The transducer assembly of claim 22 further comprising means for adjusting a distance between the housing and the strings when the transducer assembly is secured to the surface of the instrument.

24. The transducer assembly of claim 23 wherein the coupling member is secured to the suction cup, and the adjusting means comprises a screw for threaded engagement with the coupling member, and a cover member in captured engagement with the screw, the cover member enveloping the coupling member and hiding from view the coupling member.

25. The transducer assembly of claim 19 further comprising a printed circuit board (PCB) disposed within the housing adjacent to the bottom portion for conducting electrical signals received from the transducers.

26. A method of detachably securing a plurality of transducers to an instrument having a plurality of strings comprising the steps of:

providing a housing having a top portion and a bottom portion, the housing top portion having a first end and a second, opposite end, and an annular ring extending outwardly from each of the first end and the second end, the housing having a plurality of transducers located therein, a quick connect device comprising two suction cuds connected to opposite ends of the housing and coupled to the housing by way of a coupling member, wherein each suction cup includes a head and each coupling member includes a circular opening for receiving the head of one of the suction cups for securing the suction cup thereto, a means for adjusting a distance between the housing and the strings comprising a pair of cooperatively engaged threaded members, and a means for interfacing the transducers to an electronic device;

securing the quick connect device to a surface of the instrument proximate the strings such that the housing is located between the surface and the strings; and adjusting the distance between the housing and the strings.

* * * * *